US008574399B2

(12) United States Patent
Hermans et al.

(10) Patent No.: US 8,574,399 B2
(45) Date of Patent: Nov. 5, 2013

(54) TISSUE PRODUCTS HAVING A HIGH DEGREE OF CROSS MACHINE DIRECTION STRETCH

(75) Inventors: Michael Alan Hermans, Neenah, WI (US); Samuel August Nelson, Appleton, WI (US); Mark William Sachs, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 13/238,798

(22) Filed: Sep. 21, 2011

(65) Prior Publication Data

US 2013/0068867 A1 Mar. 21, 2013

(51) Int. Cl.

| | |
|---|---|
| ***D21H 27/00*** | (2006.01) |
| ***D21H 27/30*** | (2006.01) |
| ***D21H 15/00*** | (2006.01) |
| ***B32B 29/00*** | (2006.01) |

(52) U.S. Cl.

USPC ..... 162/109; 163/117; 163/123; 163/125; 163/204; 428/156; 428/172

(58) Field of Classification Search

USPC ..... 162/109, 117, 118, 123, 125, 204, 207; 428/34.2, 156, 172

See application file for complete search history.

(56) References Cited

U.S. PATENT DOCUMENTS

| | | | | |
|---|---|---|---|---|
| 4,440,597 | A | 4/1984 | Wells et al. | |
| 4,638,907 | A * | 1/1987 | Bedenk et al. | 510/277 |
| 5,607,551 | A | 3/1997 | Farrington et al. | |
| 5,656,132 | A * | 8/1997 | Farrington et al. | 162/117 |
| 5,672,248 | A | 9/1997 | Wendt et al. | |
| 5,746,887 | A | 5/1998 | Wendt et al. | |
| 5,772,845 | A | 6/1998 | Farrington et al. | |
| 5,830,321 | A | 11/1998 | Lindsay et al. | |
| 6,017,417 | A * | 1/2000 | Wendt et al. | 162/109 |
| 7,294,229 | B2 | 11/2007 | Hada et al. | |
| 7,726,349 | B2 | 6/2010 | Mullally et al. | |
| 7,935,221 | B2 * | 5/2011 | Allen et al. | 162/116 |
| 7,972,474 | B2 | 7/2011 | Underhill et al. | |
| 2004/0118544 | A1 | 6/2004 | Tirimacco et al. | |
| 2005/0148257 | A1 * | 7/2005 | Hermans et al. | 442/327 |
| 2005/0236122 | A1 * | 10/2005 | Mullally et al. | 162/109 |
| 2005/0241786 | A1 * | 11/2005 | Edwards et al. | 162/109 |
| 2006/0086472 | A1 * | 4/2006 | Hermans et al. | 162/111 |
| 2007/0000629 | A1 * | 1/2007 | Tirimacco et al. | 162/109 |
| 2007/0131366 | A1 * | 6/2007 | Underhill et al. | 162/109 |
| 2007/0137807 | A1 * | 6/2007 | Schulz et al. | 162/109 |
| 2008/0035288 | A1 * | 2/2008 | Mullally et al. | 162/109 |
| 2009/0065160 | A1 * | 3/2009 | Hermans et al. | 162/112 |
| 2009/0194244 | A1 * | 8/2009 | Harper et al. | 162/111 |
| 2010/0051217 | A1 * | 3/2010 | Allen et al. | 162/116 |
| 2010/0051218 | A1 * | 3/2010 | Allen et al. | 162/116 |
| 2010/0319863 | A1 * | 12/2010 | Hermans et al. | 162/100 |
| 2011/0155337 | A1 * | 6/2011 | Murray et al. | 162/111 |
| 2012/0247698 | A1 * | 10/2012 | Murray et al. | 162/111 |
| 2013/0068867 | A1 * | 3/2013 | Hermans et al. | 242/160.4 |

FOREIGN PATENT DOCUMENTS

| | | | |
|---|---|---|---|
| WO | WO 00/08253 | A1 | 2/2000 |
| WO | WO 2007078562 | A2 * | 7/2007 |
| WO | WO 2010023616 | A2 * | 3/2010 |

* cited by examiner

*Primary Examiner* — Jose A Fortuna
(74) *Attorney, Agent, or Firm* — Michael J. Sullivan

(57) ABSTRACT

The present invention provides tissue products having increased CD stretch, which may be manufactured using a process in which the nascent web is subjected to two distinct rush transfers. The first rush transfer occurs when the web is transferred from the forming fabric to the transfer fabric, i.e., the "first position," and the second occurs when the web is transferred from the transfer fabric to the through-air drying fabric (TAD) fabric, i.e., the "second position." The overall speed differential between the forming fabric and the TAD fabric may be, for example, from about 10 to about 50 percent, with the amount of rush transfer being divided between the first and second position in a manner sufficient to achieve the desired CD stretch and other sheet properties.

17 Claims, 4 Drawing Sheets

TISSUE PRODUCTS HAVING A HIGH DEGREE OF CROSS MACHINE DIRECTION STRETCH

BACKGROUND

In the field of tissue products, such as facial tissue, bath tissue, table napkins, paper towels and the like, the cross machine direction (CD) stretch of a sheet of paper is an important characteristic or property. As tissue products tend to fail in the cross machine direction, an increase in the CD stretch will generally increase the durability and strength of the tissue product at a given tensile strength. Similarly, increasing CD stretch may also improve the hand feel of the tissue product in-use. Increased CD stretch may also improve the manufacturing efficiency of tissue products, particularly the efficiency of converting operations, which would benefit from increases in strength and durability. Thus, it may be desirable to increase the amount of CD stretch over that which is obtained by conventional methods and found in conventional sheets. For example, a creped tissue may have a CD stretch of about 4 to about 5 percent. These levels of CD stretch have been increased in through-air dried uncreped tissues, such as those disclosed in commonly assigned U.S. Pat. Nos. 6,017,417, 7,156,953 and 7,294,229, to about 10 percent. While these products have increased CD stretch, the need remains for tissue basesheets having even higher degrees of CD stretch while retaining other important sheet properties.

Furthermore, many methods for increasing stretch tend to decrease tensile strength. For example, creping is often used to increase machine direction stretch, but creping tends to decrease the strength of the web. Similarly, foreshortening of the web in the CD can reduce CD tensile strength. As both tensile and stretch are important to web durability, it is desired to simultaneously have both high CD tensile and high CD stretch to maximize the durability of the web in the CD. While MD and CD tensile can be increased by refining or strengthening agents, it is not desirable to significantly increase the MD tensile as this excessively reduces the softness of the web. As such, the need remains for tissue basesheets having even higher degrees of CD stretch and CD tensile while retaining other important sheet properties.

SUMMARY

It has now been surprisingly discovered that levels of CD stretch may be increased by manufacturing a tissue sheet using a process in which the nascent web is subjected to two distinct rush transfers. The term "rush transfer" generally refers to the process of subjecting the nascent web to differing speeds as it is transferred from one fabric in the papermaking process to another. The present disclosure provides a process in which the nascent web is subjected to two distinct rush transfers, the first occurring when the web is transferred from the forming fabric to the transfer fabric, i.e., the "first position," and the second occurring when the web is transferred from the transfer fabric to the through-air drying fabric (TAD) fabric, i.e., the "second position." The overall speed differential between the forming fabric and the TAD fabric may be, for example, from about 10 to about 50 percent, with the amount of rush transfer being divided between the first and second position in a manner sufficient to achieve the desired CD stretch and other sheet properties.

Accordingly, in certain embodiments the present disclosure offers an improvement in papermaking methods and products, by providing a tissue sheet and a method to obtain a tissue sheet, with improved CD stretch. Thus, by way of example, the present disclosure provides a tissue sheet having a CD stretch greater than about 15 percent and a CD tensile strength greater than about 750 grams per 3 inches. The increase in CD stretch improves the hand feel of the tissue product, while also reducing the tendency of a sheet to tear in the machine direction (MD) in use.

In another aspect, the present disclosure provides a tissue web comprising one or more tissue plies, at least one tissue ply having a percent CD stretch greater than about 15 percent and a CD tensile strength greater than about 750 grams per 3 inches.

In another aspect, the present disclosure provides a multiply tissue web comprising two or more plies, the product having a percent CD stretch greater than about 18 percent and a CD tensile strength greater than about 700 grams per 3 inches.

In still other aspects, the present disclosure provides a rolled tissue product comprising a tissue web spirally wound into a roll, the wound roll having a roll bulk of at least about 22 cc/g and a Kershaw firmness of less than about 7 mm.

In another aspect, the present disclosure provides a method of making a tissue sheet comprising the steps of: (a) depositing an aqueous suspension of papermaking fibers onto a forming fabric traveling at a first rate of speed to form a wet web; (b) dewatering the web to a consistency of about 20 percent or greater; (c) rush transferring the dewatered web to a transfer fabric, the transfer fabric traveling at a rate of speed from about 1 to about 30 percent slower than the speed of the forming fabric; (d) rush transferring the web to a throughdrying fabric, the transfer fabric traveling at a rate of speed from about 1 to about 30 percent slower than the speed of the forming transfer fabric; and (e) throughdrying the web.

In still other aspects the present disclosure provides a method of making a tissue product having high CD stretch and tensile, the method comprising the steps of: (a) depositing an aqueous suspension of papermaking fibers onto a forming fabric traveling at a first rate of speed to form a wet web; (b) dewatering the web to a consistency of about 20 percent or greater; (c) rush transferring the dewatered web to a transfer fabric, the transfer fabric traveling at a rate of speed from about 1 to about 30 percent slower than the speed of the forming fabric; (d) rush transferring the web to a throughdrying fabric, the transfer fabric traveling at a rate of speed from about 1 to about 30 percent slower than the speed of the transfer fabric; and (e) throughdrying the web to form a tissue product, the tissue product having a percent CD stretch greater than about 15 percent and a CD tensile strength greater than about 800 grams per 3 inches.

DEFINITIONS

Figure 1:
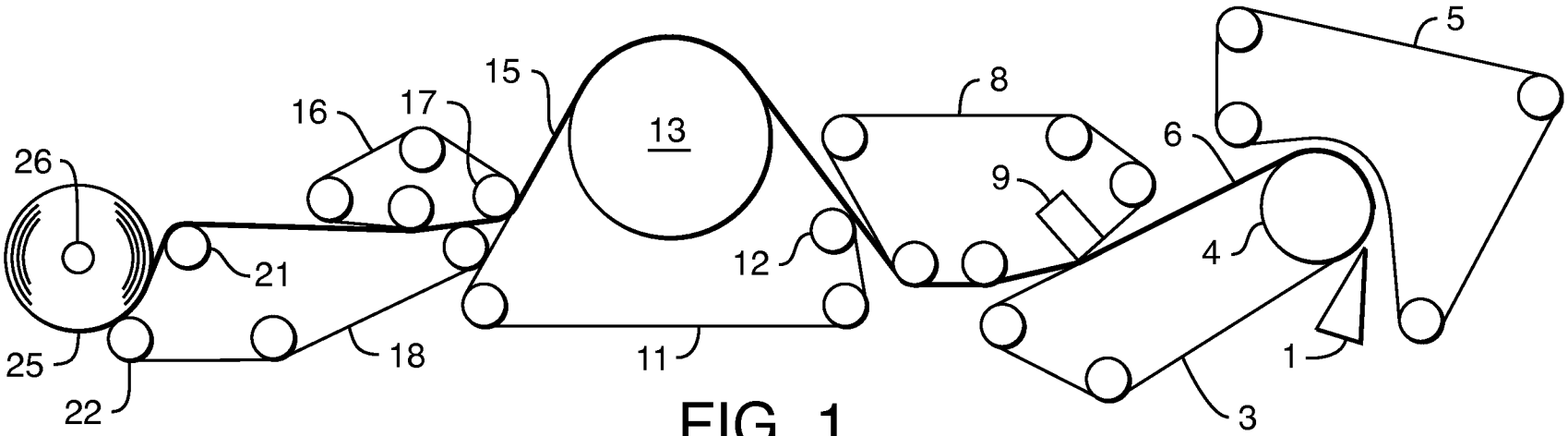
FIG. 1 illustrates one method of manufacturing a tissue product according to the present disclosure.

As used herein, the term "tissue product," refers to products made from base webs comprising fibers and includes, bath tissues, facial tissues, paper towels, industrial wipers, foodservice wipers, napkins, medical pads, and other similar products.

As used herein, the terms "tissue web" or "tissue sheet" refer to a cellulosic web suitable for making or use as a facial tissue, bath tissue, paper towels, napkins, or the like. It can be layered or unlayered, creped or uncreped, and can consist of a single ply or multiple plies. The tissue webs referred to above are preferably made from natural cellulosic fiber sources such as hardwoods, softwoods, and nonwoody species, but can also contain significant amounts of recycled fibers, sized or chemically-modified fibers, or synthetic fibers.

As used herein, the term "Roll Bulk," refers to the volume of paper divided by its mass on the wound roll. Roll Bulk is calculated by multiplying pi (3.142) by the quantity obtained by calculating the difference of the roll diameter squared in cm squared (cm$^2$) and the outer core diameter squared in cm squared (cm$^2$) divided by 4, divided by the quantity sheet length in cm multiplied by the sheet count multiplied by the bone dry Basis Weight of the sheet in grams (g) per cm squared (cm$^2$).

As used herein, the "Geometric mean tensile strength (GMT)," refers to the square root of the product of the machine direction tensile strength and the cross machine direction tensile strength of the web. As used herein, tensile strength refers to mean tensile strength as would be apparent to one skilled in the art. Geometric tensile strengths are measured using an MTS Synergy tensile tester using a 3 inches sample width, a jaw span of 2 inches, and a crosshead speed of 10 inches per minute after maintaining the sample under TAPPI conditions for 4 hours before testing. A 50 Newton maximum load cell is utilized in the tensile test instrument.

As used herein, the term "Kershaw Test," refers to the roll firmness as determined using the Kershaw Test as described in detail in U.S. Pat. No. 6,077,590 to Archer, et al., which is incorporated herein by reference. The apparatus is available from Kershaw Instrumentation, Inc. (Swedesboro, N.J.), and is known as a Model RDT-2002 Roll Density Tester.

As used herein, the term "CD Stretch," refers to the maximum tensile strain developed in a tissue web or product, in the cross machine direction, before rupture in a tensile test carried out in accordance with TAPPI test method T 576. The stretch is expressed as a percentage, i.e., one hundred times the ratio of the increase in length of the tissue web or product to the original test span.

DETAILED DESCRIPTION

Subjecting a nescient web to a speed differential as it is passed from one fabric in the papermaking process to another is known in the art and commonly referred to as rush transfer. Rush transfer is typically used to provide machine direction (MD) stretch in the web, and is normally performed when the web is transferred from the forming fabric to the transfer fabric. Speed differentials between the forming fabric and the transfer fabric of from about 20 to about 30 percent are typical, and the resulting tissue generally has a MD stretch similar to the rush-transfer speed differential, expressed in percent, i.e., an MD stretch from about 20 to about 30 percent. The amount of stretch in the cross machine (CD) direction, however, is significantly less, only about 5 to about 10 percent, and generally does not increase with increasing amounts of rush transfer. However, it has now been discovered that CD stretch may be increased without negatively effecting other sheet properties by providing a second rush transfer as the web is transferred from the transfer fabric to the TAD fabric. By dividing the rush transfer between two different positions, it has been discovered that not only can MD stretch be introduced to the sheet, but that CD stretch may be increased.

Suitable papermaking processes useful for making tissue sheets in accordance with this invention include uncreped throughdrying processes which are well known in the tissue and towel papermaking art. Such processes are described in U.S. Pat. Nos. 5,607,551, 5,672,248, and 5,593,545, all of which are hereby incorporated by reference herein in a manner consistent with the present disclosure.

Referring to FIG. 1, a process of carrying out using the present invention will be described in greater detail. The process shown depicts an uncreped through dried process, but it will be recognized that any known papermaking method or tissue making method can be used in conjunction with the nonwoven tissue making fabrics of the present invention. Related uncreped through-air dried tissue processes are described for example, in U.S. Pat. Nos. 5,656,132 and 6,017,417, both of which are hereby incorporated by reference herein in a manner consistent with the present disclosure.

In FIG. 1, a twin wire former having a papermaking headbox 10 injects or deposits a furnish of an aqueous suspension of papermaking fibers onto a plurality of forming fabrics, such as the outer forming fabric 5 and the inner forming fabric 3, thereby forming a wet tissue web 6. The forming process of the present invention may be any conventional forming process known in the papermaking industry. Such formation processes include, but are not limited to, Fourdriniers, roof formers such as suction breast roll formers, and gap formers such as twin wire formers and crescent formers.

The wet tissue web 6 forms on the inner forming fabric 3 as the inner forming fabric 3 revolves about a forming roll 4. The inner forming fabric 3 serves to support and carry the newly-formed wet tissue web 6 downstream in the process as the wet tissue web 6 is partially dewatered to a consistency of about 10 percent based on the dry weight of the fibers. Additional dewatering of the wet tissue web 6 may be carried out by known paper making techniques, such as vacuum suction boxes, while the inner forming fabric 3 supports the wet tissue web 6. The wet tissue web 6 may be additionally dewatered to a consistency of at least about 20 percent, more specifically between about 20 to about 40 percent, and more specifically about 20 to about 30 percent.

The forming fabric 3 can generally be made from any suitable porous material, such as metal wires or polymeric filaments. For instance, some suitable fabrics can include, but are not limited to, Albany 84M and 94M available from Albany International (Albany, N.Y.) Asten 856, 866, 867, 892, 934, 939, 959, or 937; Asten Synweve Design 274, all of which are available from Asten Forming Fabrics, Inc. (Appleton, Wis.); and Voith 2164 available from Voith Fabrics (Appleton, Wis.). Forming fabrics or felts comprising nonwoven base layers may also be useful, including those of Scapa Corporation made with extruded polyurethane foam such as the Spectra Series.

Suitable cellulosic fibers for use in connection with this invention include secondary (recycled) papermaking fibers and virgin papermaking fibers in all proportions. Such fibers include, without limitation, hardwood and softwood fibers as well as nonwoody fibers. Noncellulosic synthetic fibers can also be included as a portion of the furnish. It has been found that a high quality product having a unique balance of properties may be made using predominantly secondary fibers or all secondary fibers.

Wet strength resins may be added to the furnish as desired to increase the wet strength of the final product. Presently, the most commonly used wet strength resins belong to the class of polymers termed polyamide-polyamine epichlorohydrin resins. There are many commercial suppliers of these types of resins including Hercules, Inc. (Kymene™) Henkel Corp. (Fibrabond™), Borden Chemical (Cascamide™), Georgia-Pacific Corp. and others. These polymers are characterized by having a polyamide backbone containing reactive crosslinking groups distributed along the backbone. Other useful wet strength agents are marketed by American Cyanamid under the Parez™ tradename.

Similarly, dry strength resins can be added to the furnish as desired to increase the dry strength of the final product. Such dry strength resins include, but are not limited to carboxymethyl celluloses (CMC), any type of starch, starch derivatives, gums, polyacrylamide resins, and others as are well known. Commercial suppliers of such resins are the same those that supply the wet strength resins discussed above.

The wet web 6 is then transferred from the forming fabric 3 to a transfer fabric 8 while at a solids consistency of between about 10 to about 35 percent, and particularly, between about 20 to about 30 percent. As used herein, a "transfer fabric" is a fabric that is positioned between the forming section and the drying section of the web manufacturing process.

Transfer to the transfer fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies pressure at levels between about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

Typically, the transfer fabric 8 travels at a slower speed than the forming fabric 3 to enhance the MD and CD stretch of the web, which generally refers to the stretch of a web in its cross (CD) or machine direction (MD) (expressed as percent elongation at sample failure). For example, the relative speed difference between the two fabrics can be from about 1 to about 30 percent, in some embodiments from about 5 to about 20 percent, and in some embodiments, from about 10 to about 15 percent. This is commonly referred to as "rush" transfer. During "rush transfer", many of the bonds of the web are believed to be broken, thereby forcing the sheet to bend and fold into the depressions on the surface of the transfer fabric 8. Such molding to the contours of the surface of the transfer fabric 8 may increase the MD and CD stretch of the web. Rush transfer from one fabric to another can follow the principles taught in any one of the following patents, U.S. Pat. Nos. 5,667,636, 5,830,321, 4,440,597, 4,551,199, 4,849,054, all of which are hereby incorporated by reference herein in a manner consistent with the present disclosure.

The wet tissue web 6 is then transferred from the transfer fabric 8 to a throughdrying fabric 11. Typically, the transfer fabric 8 travels at approximately the same speed as the throughdrying fabric 11. However, it has now been discovered that a second rush transfer may be performed as the web is transferred from the transfer fabric 8 to a throughdrying fabric 11. This rush transferred is referred to herein as occurring at the second position and is achieved by operating the throughdrying fabric 11 at a slower speed than the transfer fabric 8. By performing rush transfer at two distinct locations, i.e., the first and the second positions, a tissue product having increased CD stretch may be produced.

In addition to rush transferring the wet tissue web from the transfer fabric 8 to the throughdrying fabric 11, the wet tissue web 6 may be macroscopically rearranged to conform to the surface of the throughdrying fabric 11 with the aid of a vacuum transfer roll 12 or a vacuum transfer shoe like vacuum shoe 9. If desired, the throughdrying fabric 11 can be run at a speed slower than the speed of the transfer fabric 8 to further enhance MD stretch of the resulting absorbent tissue product. The transfer may be carried out with vacuum assistance to ensure conformation of the wet tissue web 6 to the topography of the throughdrying fabric 11.

While supported by the throughdrying fabric 11, the wet tissue web 6 is dried to a final consistency of about 94 percent or greater by a throughdryer 13. The web 15 then passes through the winding nip between the reel drum 22 and the reel 23 and is wound into a roll of tissue 25 for subsequent converting, such as slitting cutting, folding, and packaging.

The drying process can be any noncompressive drying method which tends to preserve, or increase, the caliper or thickness of the wet web including, without limitation, throughdrying, infra-red radiation, microwave drying, etc. Because of its commercial availability and practicality, throughdrying is well-known and is a preferred means for noncompressively drying the web for purposes of this invention. The throughdrying process and tackle can be conventional as is well known in the papermaking industry.

Once the wet tissue web 6 has been non-compressively dried, thereby forming the dried tissue web 15, it is possible to crepe the dried tissue web 15 by transferring the dried tissue web 15 to a Yankee dryer prior to reeling, or using alternative foreshortening methods such as microcreping as disclosed in U.S. Pat. No. 4,919,877.

The basis weight of single-ply tissue webs prepared according to the present disclosure can be from about 10 to about 45 grams per square meter (gsm), more specifically from about 10 to about 40 gsm, still more specifically from about 15 to about 35 gsm, more specifically from about 20 to about 35 gsm and still more specifically from about 30 to about 35 gsm. Optionally, in some embodiments, multiple throughdried sheet can be plied together to form a multi-ply product having two, three, four or more plies. The basis weight of a multi-ply product depends upon the number of plies and the basis weight of each ply.

The MD and CD tensile strengths of webs prepared according to the present disclosure can be from about 400 to about 1800 grams or greater per 3 inches of sample width, more specifically from about 1000 to about 1600 grams per 3 inches of sample width and still more specifically from about 1300 to about 1500 grams per 3 inches of sample width. The ratio of MD to CD tensile will generally be greater than 1, for example from about 1.5 to about 2 and more specifically from about 1.6 to about 1.8.

The geometric mean tensile strength (GMT) of webs prepared according to the present disclosure can be about from about 500 to about 1500 grams per 3 inches of width, more specifically from about 800 to about 1300 grams per 3 inches of width and more specifically from about 900 to about 1200 grams per 3 inches of width.

The MD stretch for webs prepared according to the present disclosure can be about 5 percent or greater, more specifically about 10 percent or greater, more specifically from about 10 to about 40 percent and more specifically from about 15 to about 30 percent.

The CD stretch webs prepared according to the present disclosure can be about 5 percent or greater, more specifically about 10 percent or greater, more specifically from about 5 to about 20 percent, more specifically from about 10 to about 20 percent and more specifically from about 15 to about 20 percent. Because the CD stretch of webs prepared according to the present disclosure can be substantially increased by various factors, primarily dividing the rush transfer between two positions in the manufacturing process, and because the MD stretch can be reduced by various factors in order to make the MD TEA and CD TEA substantially equal. In certain instances the CD stretch may be approximately equal to the MD stretch.

Tissue webs of the present disclosure will generally have a CD TEA greater than about 6 gram-centimeters per square centimeter, more specifically from about 6 to about 8 gram-centimeters per square centimeter.

The webs prepared according to the present disclosure can be layered or non-layered (blended). Layered sheets can have two, three or more layers. For tissue sheets that will be converted into a single-ply product, it can be advantageous to have three layers with the outer layers containing primarily hardwood fibers and the inner layer containing primarily softwood fibers. Tissue sheets in accordance with this invention would be suitable for all forms of tissue products including, but not limited to, bathroom tissue, kitchen towels, facial tissue and table napkins for consumer and services markets.

The various fabrics used to produce the towels of the present invention, particularly the throughdrying fabric and the transfer fabric, have a topographical structure that imparts three-dimensionality to the resulting tissue sheet or ply. This three-dimensionality in turn imparts CD stretch to the sheet because the three-dimensional bumps and/or ridges can be pulled out when the sheet is stressed. This increased "topography" of the fabric is often interchangeably referred to as increased "strain", with respect to the fabric, and reflects the increased strain that is imparted to the material webs that are formed thereon.

Suitable three-dimensional fabrics useful for purposes of this invention are those fabrics having a top surface and a bottom surface. During wet molding and/or throughdrying, the top surface supports the wet tissue web. The wet tissue web conforms to the top surface and during molding is strained into a three-dimensional topographic form corresponding to the three-dimensional topography of the top surface of the fabric. Adjacent the bottom surface, the fabric has a load-bearing layer which integrates the fabric and provides a relatively smooth surface for contact with various tissue machine elements.

Fabrics can be woven or nonwoven, or a combination of a woven substrate with an extruded sculpture layer which provides the topographical sculptured layer. Fabrics may also be finished so the warps are parallel to the cross machine direction when run on a tissue machine, creating a series of substantially continuous cross machine direction ridges separated by valleys.

The transfer and TAD fabrics used herein have textured sheet-contacting surfaces comprising of substantially continuous machine direction ridges separated by valleys and are similar to those described in U.S. Pat. No. 6,673,202, herein incorporated by reference in a manner consistent with the present invention. Furthermore, such fabrics with ridged sculpted layers can be extended to include ridges having a height of from 0.4 to about 5 mm, a ridge width of 0.5 mm or greater and a CD ridge frequency of from about 1.5 to about 8 per centimeter. Specific fabric styles described in this manner include, for example, Voith Fabrics t1205-1, which has 3.02 ripples/cm and a ridge height of approximately 0.8 mm Other fabrics with varying degrees of surface topography are also available.

By comparison, flat fabrics that are commonly used in paper product manufacturing, such as the 44GST fabric pattern available from Voith Fabrics, have much less topography than the TAD fabrics having textured sheet-contacting surfaces fabrics used herein. Such flat fabrics have no appreciable topography. Subsequently, a low topography (or "flat") fabric will generally impart very little CD strain to the fiber web.

Other fabrics suitable for use as the transfer fabric or the TAD fabric can have textured sheet-contacting surfaces comprising a waffle-like pattern consisting of both machine direction and cross machine direction ridges with sculpted layers which have a peak height (from lowest element contacted by the tissue to the highest element) ranging from 0.5 to about 8 mm, and a frequency of occurrence of the two-dimensional pattern from about 0.8 to about 3.6 per square centimeter of fabric.

EXAMPLES

Example 1

Tissue samples were produced as described in U.S. Pat. No. 5,772,845, the disclosure of which is hereby incorporated by reference in a manner consistent with the present disclosure, on a tissue machine having a forming fabric, transfer fabric and throughdrying fabric. Single-ply tissue was produced with a target BW of 40 gsm using a blended furnish of 50 percent by weight northern softwood and 50 percent eucalyptus fibers. The furnish was not refined and no chemicals were added.

For all codes the total rush transfer level was set at 28 percent, i.e., the TAD fabric was set to run at speed that was 28 percent slower than the forming fabric. For the control samples (Sample Nos. 1, 6, 9 and 14) all of the rush transfer was accomplished as the web was transferred from the forming fabric to transfer fabric (first position). For the inventive samples a portion of the total transfer was performed as the web was transferred from the transfer fabric to the TAD fabric (second position). In each instance, regardless of whether rush transfer was performed at the first, second or both positions, the total rush transfer was 28 percent. For the inventive samples the rush transfer was split between the first and second position as follows: 21/7, 14/14, 7/21 and 0/28, where the first value represents the percent rush transfer occurring at the first position and the second represents the percent rush transfer occurring at the second position. The forming fabric was a Voith 2164, the TAD fabric was the fabric described as "Jack" in U.S. Pat. No. 7,611,607, which is incorporated herein in a manner consistent with the present disclosure, and the transfer fabrics were either a Voith 2164 or the fabric described as "Jetson" in U.S. Pat. No. 7,611,607, as specified in Table 1 below.

For each sample machine conditions and chemical additions were held constant and no effort was made to compensate for changes caused by the rush-transfer changes. Similarly, unless specified, other variables such as vacuum levels, TAD and reel settings, and pulper conditions were left constant so as to observe only the changes caused by altering the rush transfer locations. The resulting physical characteristics are summarized in Table 2, below. In Table 2, the designation R or R2 after a code number reflects a repeat run for a given code. For example, 1R is a repeat of code 1 and 1R2 is the second repeat of code 1. The repeats were run to ensure reproducibility of the experimental data.

TABLE 1

| Sample No. | Transfer Fabric | % Rush Transfer Position 1 | % Rush Transfer Position 2 | Transfer Vacuums Positions 1 and 2 |
|---|---|---|---|---|
| Control 1 | Jetson | 28 | 0 | high |
| 2 | Jetson | 21 | 7 | high |
| 3 | Jetson | 14 | 14 | high |
| 4 | Jetson | 7 | 21 | high |
| 5 | Jetson | 0 | 28 | high |
| Control 6 | Jetson | 28 | 0 | low |
| 7 | Jetson | 14 | 14 | low |
| 8 | Jetson | 0 | 28 | low |
| Control 9 | 2164 | 28 | 0 | high |
| 10 | 2164 | 21 | 7 | high |
| 11 | 2164 | 14 | 14 | high |
| 12 | 2164 | 7 | 21 | high |
| 13 | 2164 | 0 | 28 | high |
| Control 14 | 2164 | 28 | 0 | high |
| 15 | 2164 | 21 | 7 | high |
| 16 | 2164 | 14 | 14 | high |
| 17 | 2164 | 7 | 21 | high |
| 18 | 2164 | 0 | 28 | high |

and CD direction. Samples prepared according to prior art methods on the other hand, have MD/CD slope ratios greater than 1 and in some cases about 2.

TABLE 3

| Sample No. | MD/CD Slope Ratio | CD Tensile/CD Stretch |
|---|---|---|
| 1 | 1.33 | 61 |
| 2 | 1.98 | 54 |
| 1R | 1.35 | 60 |
| 2R | 2.12 | 55 |
| 3 | 2.08 | 55 |
| 4 | 1.60 | 52 |
| 5 | 1.14 | 50 |
| 1R2 | 1.52 | 58 |
| 6 | 1.02 | 75 |
| 7 | 1.37 | 63 |
| 8 | 0.92 | 60 |
| 9 | 1.24 | 76 |
| 10 | 1.90 | 72 |
| 11 | 1.82 | 72 |
| 12 | 1.40 | 76 |
| 13 | 0.97 | 78 |
| 9R | 1.30 | 77 |
| 14 | 2.01 | 78 |
| 15 | 2.28 | 74 |
| 16 | 1.94 | 75 |
| 17 | 1.46 | 75 |
| 18 | 0.91 | 83 |
| 14R | 2.24 | 76 |

From the data of Tables 2 and 3, several graphs were constructed illustrating how properties change with the transition of some of the rush transfer from the first position to the second. Of particular interest is the change in the CD stretch as rush transfer is transitioned from the first position to the second. FIG. 1 includes the first eight samples (samples 1-5 and also 1R, 2R and 1R2) and shows CD stretch as a function

TABLE 2

| Sample No. | GMT gf | gm Slope gf | Ratio MD/CD Tensile | MDT gf | MDS % | MD Slope gf | BSMD TEA gf * cm/cm$^2$ | BSCDT gf | CDS % | CD Slope gf | CD TEA gf * cm/cm$^2$ |
|---|---|---|---|---|---|---|---|---|---|---|---|
| Control 1 | 1228 | 4.64 | 1.81 | 1652 | 23.12 | 5349 | 23.16 | 913 | 15.04 | 4021 | 8.07 |
| 2 | 1143 | 4.71 | 1.77 | 1518 | 21.61 | 6629 | 21.47 | 861 | 15.96 | 3341 | 7.79 |
| Control 1R | 1186 | 4.53 | 1.71 | 1549 | 22.58 | 5251 | 21.49 | 908 | 15.24 | 3894 | 8.07 |
| 2R | 1128 | 4.96 | 1.74 | 1488 | 21.36 | 7224 | 21.52 | 856 | 15.61 | 3400 | 7.59 |
| 3 | 1165 | 4.89 | 1.75 | 1538 | 20.74 | 7064 | 21.13 | 883 | 16.02 | 3392 | 8.03 |
| 4 | 1138 | 4.25 | 1.84 | 1543 | 21.77 | 5378 | 19.77 | 840 | 16.16 | 3362 | 7.90 |
| 5 | 1113 | 3.56 | 1.84 | 1512 | 23.74 | 3806 | 17.82 | 821 | 16.36 | 3332 | 7.86 |
| Control 1R2 | 1166 | 4.88 | 1.83 | 1556 | 22.46 | 6012 | 20.94 | 863 | 14.93 | 3960 | 7.67 |
| 6 | 1209 | 5.32 | 1.65 | 1550 | 21.90 | 5361 | 19.48 | 943 | 12.55 | 5270 | 7.11 |
| 7 | 1110 | 5.01 | 1.65 | 1424 | 20.24 | 5854 | 18.58 | 865 | 13.66 | 4286 | 7.01 |
| 8 | 1165 | 4.12 | 1.92 | 1613 | 22.99 | 3953 | 18.00 | 842 | 14.05 | 4306 | 7.09 |
| Control 9 | 1110 | 6.65 | 1.67 | 1432 | 21.68 | 7391 | 21.71 | 860 | 11.26 | 5978 | 6.20 |
| 10 | 1142 | 8.00 | 1.62 | 1453 | 19.53 | 11013 | 22.42 | 898 | 12.55 | 5808 | 7.24 |
| 11 | 1193 | 7.58 | 1.72 | 1562 | 21.01 | 10211 | 24.95 | 911 | 12.72 | 5614 | 7.29 |
| 12 | 1259 | 7.47 | 1.81 | 1690 | 21.21 | 8829 | 25.05 | 937 | 12.35 | 6315 | 7.49 |
| 13 | 1269 | 6.62 | 1.89 | 1745 | 21.84 | 6526 | 23.37 | 923 | 11.88 | 6748 | 7.22 |
| Control 9R | 1157 | 6.72 | 1.68 | 1495 | 21.97 | 7652 | 22.97 | 896 | 11.69 | 5893 | 6.65 |
| Control 14 | 973 | 7.93 | 1.28 | 1100 | 18.80 | 11256 | 18.40 | 861 | 11.08 | 5590 | 6.01 |
| 15 | 1049 | 8.24 | 1.36 | 1224 | 17.61 | 12456 | 19.22 | 900 | 12.16 | 5458 | 6.81 |
| 16 | 1187 | 8.11 | 1.55 | 1480 | 20.10 | 11311 | 24.12 | 953 | 12.75 | 5819 | 7.63 |
| 17 | 1209 | 7.21 | 1.76 | 1603 | 21.10 | 8709 | 23.93 | 911 | 12.12 | 5967 | 7.07 |
| 18 | 1288 | 7.28 | 1.75 | 1705 | 22.10 | 6942 | 23.40 | 973 | 11.76 | 7643 | 7.76 |
| 14R | 1036 | 8.36 | 1.41 | 1230 | 19.74 | 12503 | 21.42 | 872 | 11.51 | 5584 | 6.30 |

Figure 2:
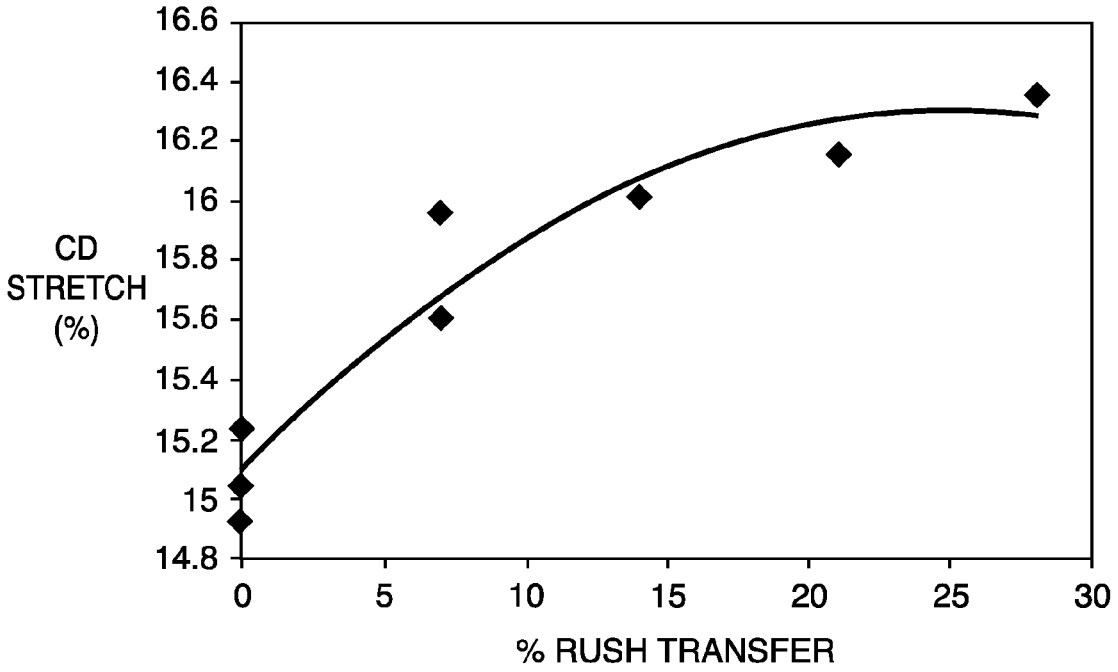
FIG. 2 illustrates the percent CD stretch (vertical axis) versus the percent rush transfer at the second location (horizontal axis) for various tissue products prepared according to the present disclosure.

Additional parameters can be calculated from the data of Table 2, which are reported in Table 3, below. As shown below, the samples in which the rush transfer is split between the first and second positions, the ratio of MD/CD slopes is reduced compared to the controls, with some samples of about 1 or less. MD/CD slope ratios of about 1 or less suggest that the samples approximately equal stiffness in both the MD of how much of the rush transfer was done at the second location for using high transfer vacuum levels and the fabric package. As shown in FIG. 2, CD stretch increased continuously as the percentage of the total rush transfer occurring at the second position increases. A similar result is illustrated in FIG. 3, which illustrates samples similar to those shown in FIG. 2, but with the transfer vacuums reduced to a lower level.

Figure 3:
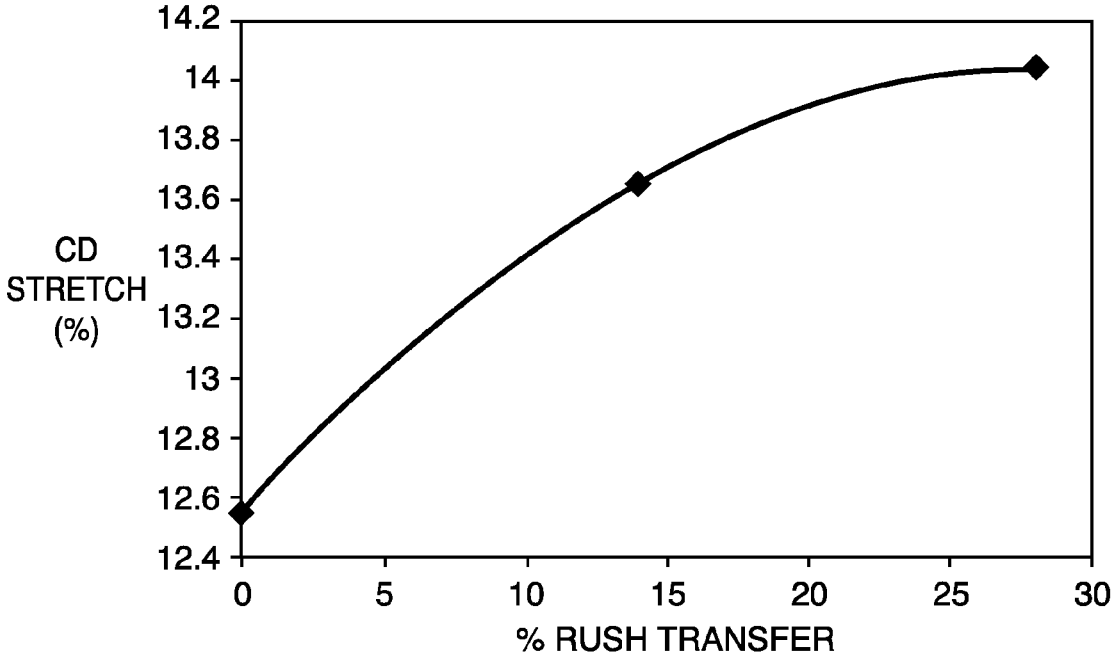
FIG. 3 illustrates the percent CD stretch (vertical axis) versus the percent rush transfer at the second location (horizontal axis) for various tissue products prepared according to the present disclosure.

FIG. 3 includes data from examples 6, 7 and 8, i.e., the sample codes produced using transfer vacuum levels of approximately 8 inches of mercury versus 11 inches for the samples of FIG. 2. A similar trend of increasing CD stretch is observed in FIG. 4, which illustrates, samples 9-13, plus code 9R, which were produced using the specified fabric combination and high transfer vacuum levels.

Figure 4:
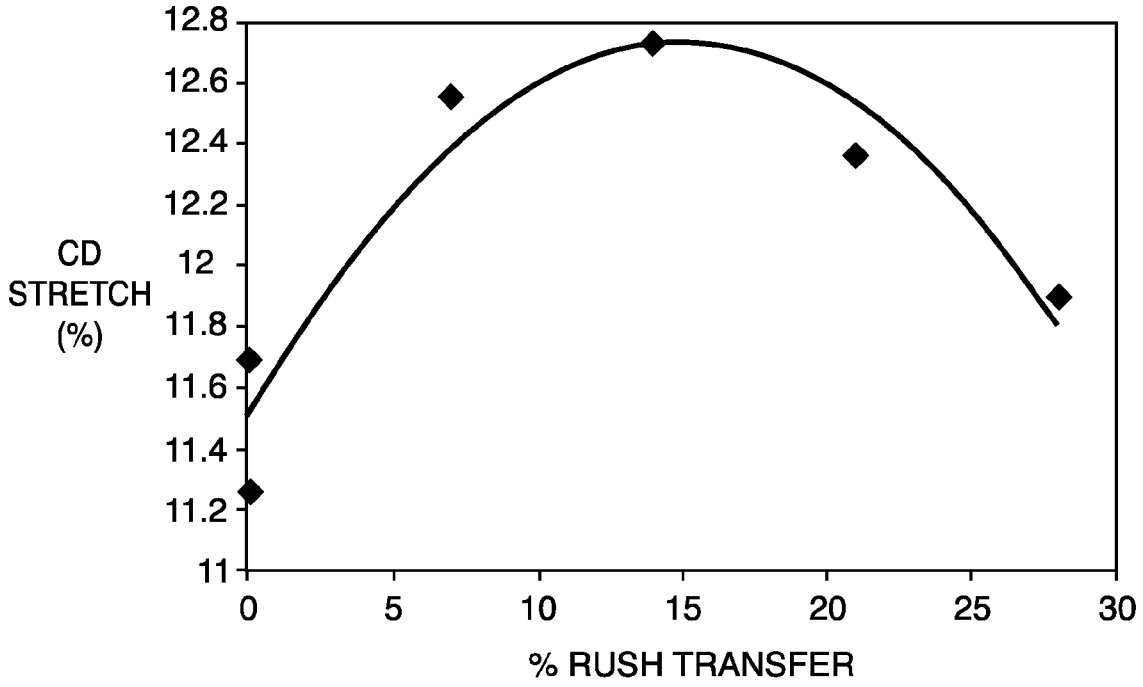
FIG. 4 illustrates the percent CD stretch (vertical axis) versus the percent rush transfer at the second location (horizontal axis) for various tissue products prepared according to the present disclosure.
Figure 5:
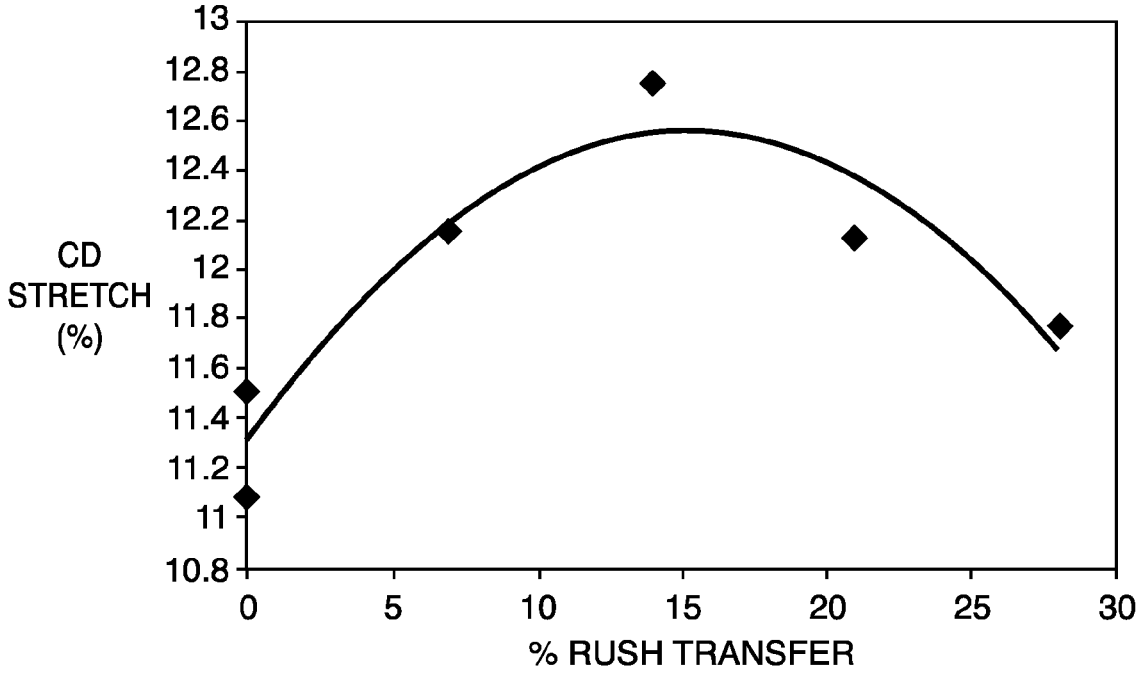
FIG. 5 illustrates the percent CD stretch (vertical axis) versus the percent rush transfer at the second location (horizontal axis) for various tissue products prepared according to the present disclosure.

FIG. 5 shows data similar to that of FIG. 4, but for samples produced using low transfer-vacuum levels similar to samples 6, 7 and 8, illustrated in FIG. 3. FIG. 5 illustrates samples prepared using the specified fabric combination, with low transfer vacuum levels, which seemingly did not exert as much impact on CD stretch compared to high vacuum levels, both in shape and absolute stretch levels.

Figure 6:
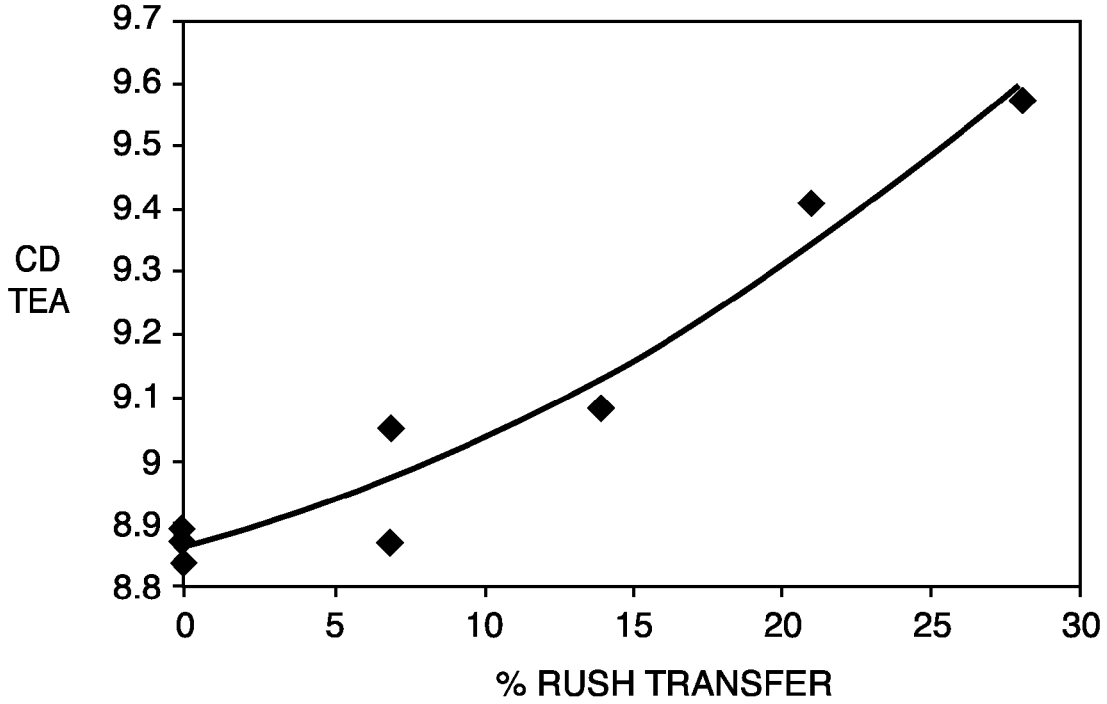
FIG. 6 illustrates CD TEA (gf*cm/cm$^2$) (vertical axis) versus percent rush transfer at the second location (horizontal axis) for various tissue products prepared according to the present disclosure.
Figure 7:
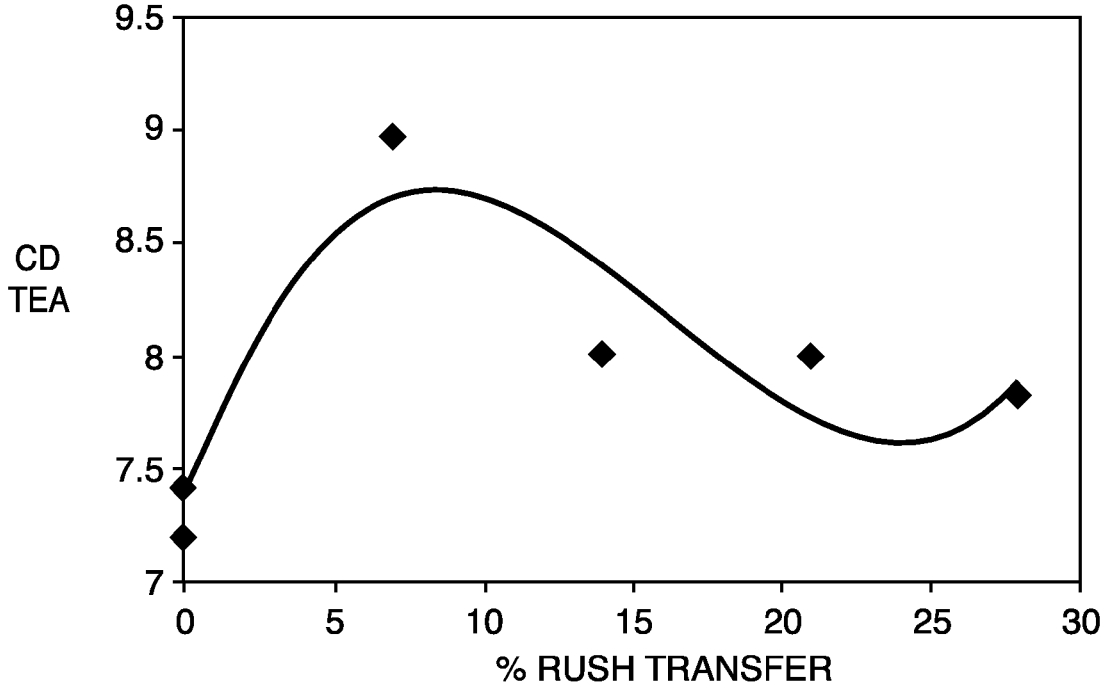
FIG. 7 illustrates CD TEA (gf*cm/cm$^2$) (vertical axis) versus percent rush transfer at the second location (horizontal axis) for various tissue products prepared according to the present disclosure.

In addition to CD stretch, another sheet property important to durability is CD TEA. FIG. 6 illustrates the effect on CD TEA as the percentage of the total rush transfer occurring at the second position increases. As shown in FIG. 6, CD TEA increases continuously with greater second position rush transfer, just as CD stretch increased.

Example 2

Tissue samples were made largely as described in Example 1 using the Jetson transfer fabric as specified in Table 1, above, with the exception that basesheets were 2-ply wherein each ply comprised three layers. The first layer comprised eucalyptus (33 percent by total weight of the ply), the second layer comprised northern softwood kraft (34 percent by total weight of the ply) and the third layer comprised eucalyptus (33 percent by total weight of the ply). Control tissues were produced with various geometric mean tensile strengths to allow comparison to the inventive codes at constant tensile strength. This was necessary because many tissue properties, such as stretch are affected by the product tensile strength. Tensile was controlled via the addition of Baystrength dry strength additive and refining. Samples were produced as indicated in Table 4. The resulting physical characteristics are summarized in Table 5, below.

TABLE 4

| Sample No. | BW (gsm per ply) | Baystrength 3000 (Kg/MT) | Refining (minutes) | Rush Transfer split |
|---|---|---|---|---|
| Control 1 | 22 | 0 | 0 | 28/0 |
| Control 2 | 22 | 3 | 2 | 28/0 |
| Control 3 | 22 | 3 | 4 | 28/0 |
| 4 | 22 | 3 | 4 | 14/14 |
| 5 | 22 | 3 | 4 | 7/21 |
| Control 6 | 24 | 3 | 4 | 28/0 |
| 7 | 24 | 3 | 4 | 14/14 |
| 8 | 24 | 3 | 4 | 7/21 |
| 9 | 24 | 3 | 4 | 21/7 |

TABLE 6

| Sample No. | Rush Transfer Split | MDS/CDS | CDS | CD Slope @ Tensile of Control |
|---|---|---|---|---|
| Control 1 | 28/0 | 1.29 | 14.55 | N/A |
| Control 2 | 28/0 | 1.09 | 17.26 | N/A |
| Control 3 | 28/0 | 1.12 | 17.86 | 2249 |
| 4 | 14/14 | 0.89 | 19.19 | 2056 |
| 5 | 7/21 | 1.08 | 18.18 | 2208 |
| Control 6 | 28/0 | 1.04 | 18.81 | 2410 |
| 7 | 14/14 | 0.84 | 20.40 | 2174 |
| 8 | 7/21 | 1.01 | 19.35 | 2279 |
| 9 | 21/7 | 0.90 | 19.57 | 2172 |

As shown in Tables 5 and 6, the basesheet cross direction properties were improved by dividing the rush transfer between the first and second positions. Comparing samples 4 and 5 to the sample control 3 which has similar CD tensile strength (controls 1 and 2 are significantly weaker in the CD direction), CD stretch was improved via the split rush transfer operation. Additionally, CD slope and hence CD stiffness was lower as well. The same result is shown in comparing control sample 6 to inventive samples 7, 8 and 9 which were all prepared by dividing the rush transfer between the first and second positions. Again CD stretch is increased by splitting the rush transfer and CD slope is reduced.

A desirable result is also achieved in terms of optimization of the web properties between MD and CD stretch. Samples prepared according to the present invention displayed the additional benefit of having essentially equal MD and CD stretch while maintaining high values of CD stretch. This is characterized by the MDS/CDS ratio, which can be desirably about 1 or less, such as about 0.9 or even more preferably about 0.8, while at the same time maintaining desirable CD stretch greater than about 15 percent.

The product was then converted into 2-ply tissue rolls using standard converting technology. Each 2-ply roll was converted without embossing or calendaring and wound to achieve a target Kershaw firmness of 5.5 to 7.5 with a roll diameter of about 125 mm. The post-converting roll and sheet properties are shown in the table below.

TABLE 7

| | Control 10 | Control 11 | Control 12 | Sample 13 | Control 14 | Sample 15 |
|---|---|---|---|---|---|---|
| Roll Weight (g) | 69.15 | 60.98 | 58.99 | 54.66 | 62.99 | 64.77 |
| Roll Bulk (cc/g) | 17.10 | 19.21 | 21.82 | 22.04 | 18.55 | 19.03 |
| Kershaw Firmness (mm) | 8.00 | 7.40 | 7.37 | 6.90 | 5.43 | 5.50 |
| Rush Transfer Split | 28/0 | 28/0 | 28/0 | 14/14 | 28/0 | 14/14 |
| BW (g/m$^2$) | 39.90 | 40.52 | 40.96 | 40.38 | 45.53 | 43.76 |

TABLE 5

| Sample No. | GMT gf | gm Slope gf | Ratio MD/CD Tensile | MDT gf | MDS % | MD Slope gf | BSMD TEA gf * cm/cm$^2$ | BSCDT gf | CDS % | CD Slope gf | CD TEA gf * cm/cm$^2$ |
|---|---|---|---|---|---|---|---|---|---|---|---|
| Control 1 | 626 | 2.97 | 1.77 | 832 | 18.81 | 3703 | 10.37 | 471 | 14.55 | 2388 | 3.90 |
| Control 2 | 837 | 3.35 | 1.81 | 1124 | 18.87 | 5158 | 14.31 | 623 | 17.26 | 2176 | 5.63 |
| Control 3 | 1074 | 3.78 | 1.94 | 1495 | 20.00 | 6351 | 20.82 | 772 | 17.86 | 2249 | 6.88 |
| 4 | 1010 | 3.66 | 1.73 | 1329 | 17.08 | 6497 | 15.49 | 767 | 19.19 | 2056 | 7.33 |
| 5 | 1038 | 3.55 | 2.00 | 1468 | 19.69 | 5693 | 17.84 | 735 | 18.18 | 2208 | 6.83 |
| Control 6 | 1173 | 3.93 | 1.80 | 1571 | 19.50 | 6380 | 20.04 | 876 | 18.81 | 2410 | 8.27 |
| 7 | 1182 | 4.26 | 1.64 | 1514 | 17.11 | 8339 | 18.18 | 923 | 20.40 | 2174 | 9.12 |
| 8 | 1169 | 3.74 | 1.89 | 1605 | 19.52 | 6140 | 19.11 | 853 | 19.35 | 2279 | 8.30 |
| 9 | 1166 | 4.12 | 1.69 | 1516 | 17.58 | 7826 | 18.74 | 898 | 19.57 | 2172 | 8.43 |

TABLE 7-continued

| | Control 10 | Control 11 | Control 12 | Sample 13 | Control 14 | Sample 15 |
|---|---|---|---|---|---|---|
| BW/Ply (g/m$^2$) | 22 | 22 | 22 | 22 | 24 | 24 |
| Abs. Cap. (g) | 73.3 | 77.6 | 81.2 | 80.1 | 82.8 | 82.2 |
| GMT (g/3 inches) | 502 | 691 | 890 | 794 | 1002 | 940 |
| CD-Peak Load (gf/3 inches) | 400 | 515 | 672 | 596 | 789 | 724 |
| CD Peak Stretch (%) | 13.00 | 14.53 | 15.58 | 16.04 | 16.50 | 15.59 |
| CD TEA (gf * cm/cm$^2$) | 4.24 | 5.41 | 6.99 | 6.83 | 8.45 | 7.52 |
| CD Slope A (kgf) | 2.59 | 2.37 | 2.48 | 2.14 | 2.56 | 2.54 |
| MD-Peak Load/Sheet (gf/3 inches) | 629 | 928 | 1179 | 1058 | 1272 | 1220 |
| MD-Peak Stretch (%) | 14.75 | 16.60 | 17.22 | 15.55 | 15.83 | 14.36 |
| Burst Peak Load (gf) | 474 | 707 | 943 | 855 | 991 | 1007 |

The inventive samples (samples 13 and 15) have a higher bulk/firmness relationship, and improved CD stretch. For example, inventive sample 13 has a higher bulk (more than 22 cc/g) and improved firmness (less than 7 mm, where lower Kershaw firmness indicates a firmer, hence preferred roll) versus the controls. The same comparison can be made between inventive sample 15 and control sample 14. The inventive samples also have a lower CD slope at a constant CD tensile as well. For example, inventive sample 13 has a lower CD slope than any of control samples and inventive sample 15 has the same CD slope as control sample 14 despite being 65 grams weaker in CD tensile strength.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

We claim:

1. A single ply tissue web having a percent CD stretch greater than about 16 percent and a CD tensile strength from about 750 to about 950 grams per 3 inches.

2. The tissue web of claim 1 having a percent CD stretch from about 16 to about 20 percent.

3. The tissue web of claim 1 having a CD TEA greater than about 7.5 g-cm/cm$^2$.

4. The tissue web of claim 1 wherein the tissue web is an uncreped through-air dried web.

5. The tissue web of claim 1 having a CD Slope from about 3200 to about 3400 gf.

6. The tissue web of claim 1 having a percent CD stretch from about 16 to about 18 percent.

7. The tissue web of claim 1 having a percent CD tensile strength from about 800 to about 900 grams per 3 inches.

8. The tissue web of claim 1 having a ratio of CD tensile strength in grams per 3 inches to percent CD stretch from about 50 to about 55.

9. A multi-ply tissue product comprising two or more plies, the product having a percent CD stretch greater than about 19 percent and a CD tensile strength greater than about 700 grams per 3 inches.

10. The tissue product of claim 9 wherein the CD slope is less than about 2200 gf.

11. The tissue product of claim 9 wherein at least one of the plies comprises an uncreped through-air dried ply.

12. The multi-ply tissue product of claim 9 having a CD Slope from about 2000 to about 2400 gf.

13. The multi-ply tissue product of claim 9 having a percent CD stretch from about 19 to about 21 percent.

14. The multi-ply tissue product of claim 9 having a CD TEA greater than about 7.0 gf*cm/cm$^2$.

15. The multi-ply tissue product of claim 9 having a CD TEA from about 7.0 gf*cm/cm$^2$ to about 9.0 gf*cm/cm$^2$.

16. The multi-ply tissue product of claim 9 having a tensile strength from about 700 to about 950 grams per 3 inches.

17. The multi-ply tissue product of claim 9 having a ratio of MD stretch to CD stretch of less than about 1.0.

* * * * *